United States Patent [19]

Nickelson

[11] Patent Number: 4,663,849

[45] Date of Patent: May 12, 1987

[54] COMBINATION CAN OPENER/KNIFE SHARPENER WITH PIVOTAL MOUNTING

[75] Inventor: Robert W. Nickelson, Elk Grove Village, Ill.

[73] Assignee: John Zink Company, Tulsa, Okla.

[21] Appl. No.: 888,557

[22] Filed: Jul. 21, 1986

[51] Int. Cl.[4] ..... A47F 5/08; B24B 3/54

[52] U.S. Cl. ..... 30/296 A; 30/416; 51/5 B; 248/324

[58] Field of Search ..... 248/324, 327, 178; 51/102, 5 B; 30/416, 419, 296 R, 296 A

[56] References Cited

U.S. PATENT DOCUMENTS

| | | | |
|---|---|---|---|
| 2,236,974 | 4/1941 | Long | 30/416 |
| 2,318,350 | 5/1943 | Zimmer | 30/416 |
| 2,510,357 | 6/1950 | Wilson | 30/416 |
| 2,706,852 | 4/1955 | Straub | 51/102 X |
| 3,574,340 | 4/1971 | Busche | 248/324 |
| 3,765,085 | 10/1973 | Ponczek | 30/419 |
| •4,423,552 | 1/1984 | Bourgein | 30/296 A |
| 4,492,028 | 1/1985 | Bourgein | 30/296 A |
| 4,561,182 | 12/1985 | Yamamoto | 30/419 |
| 4,566,663 | 1/1986 | Barchus | 248/324 |

*Primary Examiner*—Jimmy C. Peters

*Attorney, Agent, or Firm*—Neil M. Rose

[57] ABSTRACT

A combination can opener and knife sharpening appliance having a generally rectangular box-shaped housing with the can opening mechanism on the front wall thereof and the knife sharpening mechanism protruding from the rear wall of the housing and provided with mounting means adapted to secure the housing to the underside of a kitchen cabinet in such a way that it may be rotated 90° between two alternative use positions.

20 Claims, 8 Drawing Figures

COMBINATION CAN OPENER/KNIFE SHARPENER WITH PIVOTAL MOUNTING

BACKGROUND OF THE INVENTION

The invention relates generally to combination can opener and knife sharpening appliances and more specifically to a combined can opener and knife sharpener which is adapted to be mounted in a depending fashion from a kitchen cabinet.

Many of the electric can openers available on the market are provided with means for sharpening knives. Typically, the electric can opener is powered by a shaded pole motor which rotates at relatively high speeds and is used to drive the feed wheel shaft of the can opener through a series of gear reductions performed by relatively inexpensive stamped or molded spur gears. It has been found that the shaded pole motors used to drive the can opener rotate at a suitable speed to power a small grinding wheel which may be mounted directly on the motor shaft and be exposed at the rear face of the can opener. Typically, a plastic guard, including guide slots for the knife blade, enclose the grinding wheel which extends beyond the rear wall of the can opener. Since the knife sharpening portion of the appliance is used relatively infrequently, it is placed on the back of the can opener housing rather than on the front where it would interfere with the use of the can opener function which takes place much more frequently.

In recent years, the limited counter space in the kitchen has become so crowded with various types of electric appliances and other food preparation utensils that there has been a movement toward mounting appliances on the wall or on the underside of cabinets so as to free more of the available counter space. As a consequence, many appliances such as coffee makers, can openers, and toaster ovens have been offered in versions which would be readily mountable on the bottom wall of a kitchen cabinet whereby the appliance would be supported at about the same height in which it would normally be used but would be spaced above the countertop.

One of the obvious problems in mounting the conventional can opener/knife sharpener appliance under the kitchen cabinet rather than providing a free standing countertop version is the fact that the knife sharpener which is conventionally on the rear wall of the can opener would be highly inaccessible or at least difficult to see and use. One possible approach to this problem might be to arrange the can opener and knife sharpener mechanism as shown in the U.S. Pat. No. 2,706,852 to Straub, et al. in which the knife sharpener is disposed in an end wall rather than a rear wall of the can opener housing. The Straub, et al. patent utilizes a series type motor which has its armature shaft extending lengthwise of the housing and driving the feed wheel shaft through a worm and worm gear. This type of gear reduction is more expensive and less efficient than the spur gear reductions which are commonly used in most can openers. In additon, the shaded pole motor with its armature shaft extending perpendicular to the front wall of the can opener housing as shown in U.S. Pat. No. 3,765,085 to Ponczek, et al. is generally favored for reasons of cost. Accordingly, it is regarded as important to provide an under-the-cabinet mounted can opener which would have the can opener mechanism on the front wall and the knife sharpening mechanism extending from the rear wall and at the same time have the appliance be easy to operate in connection with either the can opening or the knife sharpening operation.

Even though the knife sharpener attachment to a can opener is provided with guide slots to aid in positioning the knife blade properly against the grinding wheel, it is important that the attachment be in full view of the user so that the entire length of the blade may be sharpened. If the combination appliance were supported under the cabinet in such a manner that the knife sharpener was at least partly under the cabinet, thereby obscuring the user's view, it would severely limit the utility of the appliance.

There are also shown in the prior art can openers which are adapted to be mounted in several different positions so that, conceivably, a can opener might be mounted in one way to perform the can opening function and in another way to perform the knife sharpening function. Patents showing the multiple mounting features are the Straub et al. patent cited above and the Yamamoto, et al. U.S. Pat. No. 4,561,182. None of the foregoing approaches suggest a simple and effective means for mounting a combination can opener and knife sharpener having the can opener in the front and the knife sharpener in the rear.

SUMMARY OF THE INVENTION

The present invention provides an under-the-cabinet can opener which has mounting means to support the unit in a first position in which the can opening mechanism faces outwardly and is readily acessible for use and a second position in which the can opener is rotated 90° about a vertical axis to a second position in which the knife sharpening mechanism which originally protruded from the rear wall of the can opener is now easily available for sharpening knives or scissors.

It is, therefore, an object of the present invention to provide an improved combination can opener and knife sharpener which is mountable under a kitchen cabinet so that it is adapted for positioning in two alternative positions, depending on whether the appliance is used for opening cans or sharpening knives.

It is another object of the present invention to provide an improved mounting for a combination can opener/knife sharpener wherein the mounting means secures to the bottom wall of a hanging kitchen cabinet and permits detachable connection of the can opener/knife sharpener to the mounting member which has means for supporting the can opener/knife sharpener into alternative positions.

It is a further object of the present invention to provide an improved can opener/knife sharpener having means to detachably and pivotally support one end of the can opener for rotation around a vertical axis and having a detachable connection at the other end which provides support in one operating position and may be readily disengaged to permit rotation of the housing to the alternative position.

Further objects and advantages will become apparent as the following description proceeds and the features of novelty which characterize the invention will be pointed out in the claims annexed to and forming a part of the specification.

BRIEF DESCRIPTION OF THE DRAWINGS

FIG. 5*b* is a fragmentary sectional view taken on line 5B—5B of FIG. 4*b;* and

Referring to FIG. 1, there is shown a combination can opener and knife sharpener embodying my invention which is designated generally by reference numeral 11. The combined can opener/knife sharpener 11 includes a mounting block 13 which pivotally supports an appliance 15 which includes a generally rectangular housing 17.

Figure 1:
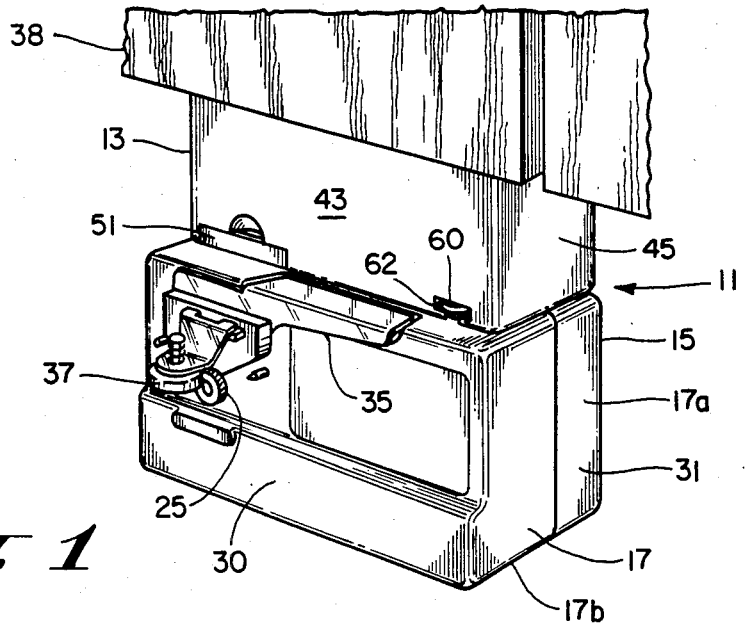
FIG. 1 is a perspective view of an electric can opener/knife sharpener embodying our invention.

The can opener/knife sharpener appliance 15 is similar from a functional standpoint to conventional counter supported can opener/knife sharpeners which include the same type of can opener and knife sharpening mechanisms. It is also similar to the under-the-cabinet mounted can openers available in the marketplace except for the manner in which is mounted under the cabinet and the fact that it carries on its rear surface a knife sharpening attachment which in conventionally mounted under-the-cabinet can openers would be inaccessible to the user.

Typical of can openers of this type, there is mounted within the housing 17 a shaded pole motor 19 including an armature shaft 19*a* which is drivingly connected through reduction gearing 21 to an output shaft 23. The shaft 23 extends through the front wall of the housing 17 and supports on its outermost end a can driving or feed wheel 25 which, in a manner well known in the art, rotates a can as the cover is severed from the can. The can is rotated about a vertical axis by the feed wheel 25, as a cutting blade 24 pierces the cover and, as the can rotates, the cutting blade 24 makes a circular cut around the cover of the can thereby opening the can.

The reduction gearing 21 includes a first input gear 21*a* on the armature shaft 19*a* and a large spur gear 21*b* which is driven by gear 21*a* and is mounted on a shaft 21*c* press fitted into a boss molded integrally with the front wall of the housing 17. Gear 21*b* is molded integrally with a small spur gear 21*d* which drives a gear 21*e* secured to output shaft 23 which carries the can drive or feed wheel 25 on its outer end. The shaft 23 is mournaled in a bearing mounted in the front wall of the housing 17.

The housing 17 is formed by a rear housing member 17*a* and a front housing member 17*b* which are secured together by screws not shown to form a box-like enclosure within which the above described motor 19 and gearing 21 are mounted. The housing 17 has a top wall 27, bottom wall 28, rear wall 29, front wall 30 and side walls 31 and 32. On the rear wall 29 there is provided a guard 33 which surrounds and encloses a grinding wheel 26 which is mounted on the rearwardly projecting end of the armature shaft 19*a*. The guard 33 is provided with slots 33*a* and 33*b* which permit a knife blade to be engaged against the conical surfaces of the rotating grinding wheel 26 to sharpen both sides of the knife edge. In addition, the guard includes a further slot 33*c* which is designed to guide scissors into proper engagement with the grinding wheel 26 for sharpening purposes.

Mounted on the front wall 30 of the appliance 15 is an operating lever 35 which supports the cutting blade 24 for movement into and out of engagement with the can being opened. The lever 35 also supports in a well known manner a magnet 37 which is designed to attract and retain the cover of a can after it is severed from the top of the can. The motor 19, the reduction gearing 21 and the output shaft 23 are all mounted on the front wall 30 of the housing 17.

Referring to FIG. 1, the can opener/knife sharpener appliance 15 is shown supported by mounting block 13 to a kitchen cabinet 38. The kitchen cabinet 38 is typical of the wall mounted cabinets found in most kitchens where the front of the cabinet is normally occupied by a door which is generally parallel to and spaced from the wall on which the cabinet is mounted. The bottom of the cabinet is usually about 18" above a countertop or work surface. It has in recent years been found advantageous to mount various types of appliances, including can openers in a depending fashion from the bottom of the kitchen wall cabinet so that the appliance is conveniently located for normal use but is not resting on the coutertop where it would occupy valuable work space. Accordingly, as shown in FIG. 1, the bottom face of the cabinet 38 is located 18" or so above the work surface and the combined can opener/knife sharpener appliance 15 is mounted about a foot above the countertop or work surface. It has been known in the art to mount can openers of the same general shape and configuration as the appliance 15 but without the knife sharpener feature on the underside of a kitchen cabinet in a fixed position. In order to accommodate the use of a knife sharpener on the rear wall of the appliance 15, there is provided the mounting block 13 which supports the appliance 15 for pivotal movement about a vertical axis.

Figure 3:
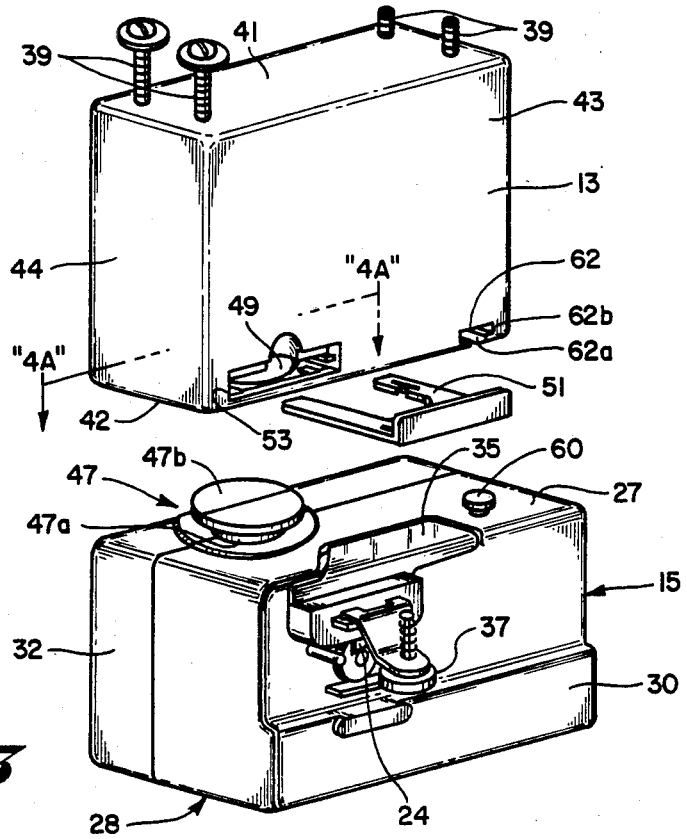
FIG. 3 is an exploded perspective view of the can opener/knife sharpener showing the support block and the housing in their disassembled positions.

The mounting block 13, as shown in FIG. 3, is adapted to be secured to the bottom wall of the kitchen cabinet 38 by means of four bolts 39 which would extend through the bottom wall of the kitchen cabinet into engagement with nuts located within the mounting block 13. The mounting block 13 is a generally rectangular box having a top wall 41, a bottom wall 42, a front wall 43 and side walls 44 and 45. The rear face of the block 13 is open.

Figure 5A:
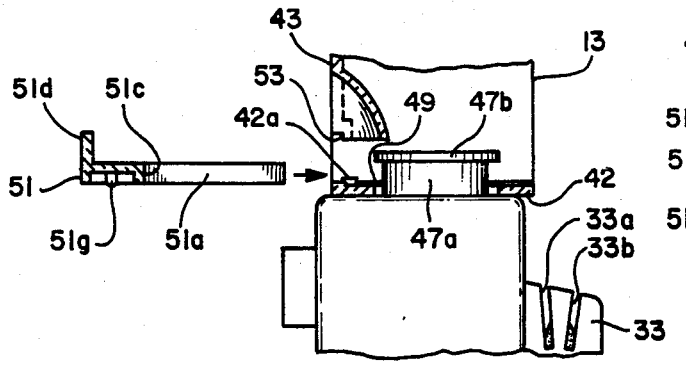
FIG. 5*b* is an enlarged fragmentary sectional view taken on line 5A—5A of FIG. 4*a;*
Figure 5B:
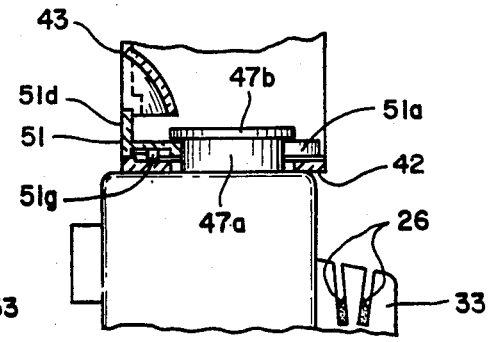

For the purpose of supporting the appliance 15 for pivotal movement with respect to the mounting block 13, there is provided on the top wall 27 of the appliance 15 a projection 47 as is best shown in FIGS. 3, 5*a* and 5*b*. The projection 47 includes a reduced diameter post portion 47*a* and a top flange portion 47*b*. In order to receive the projection 47 within the mounting block 13, the bottom wall 42 of the mounting block 13 is formed with an opening 49 which is slightly larger in diameter than the flange 47*b* so as to permit the entire projection 47 to be inserted through the opening 49 into the interior of the mounting block 13, as is shown in FIGS. 5*a* and 5*b*. For the purpose of retaining the projection 47 in position in the mounting block 13, a U-shaped lock member 51 is provided. The lock member 51 has a pair of spaced parallel legs 51*a*, a semi-circular journal portion 51*c* and a handle portion 51*d*. The radius of the circular semi-circular portion 51*c* and the spacing between the legs 51*a* corresponds to the diameter of the post portion 47*a* of the projection 47 so that the lock member 51 may more or less journal the projection 47 for rotation about a vertical axis.

Figure 4A:
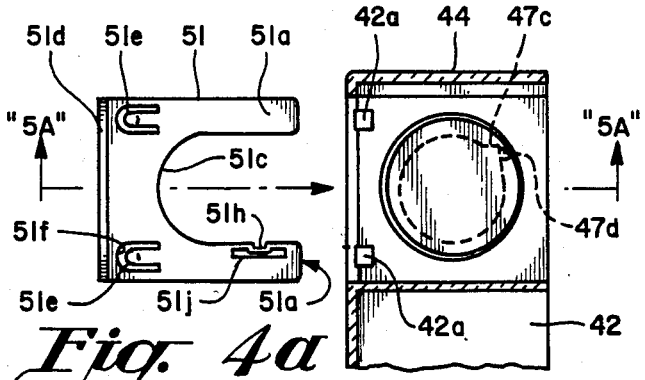
FIG. 4*a* is an enlarged fragmentary sectional view taken on line 4A—4A of FIG. 3 but showing the can opener/knife sharpener assembled to the support block.
Figure 4B:
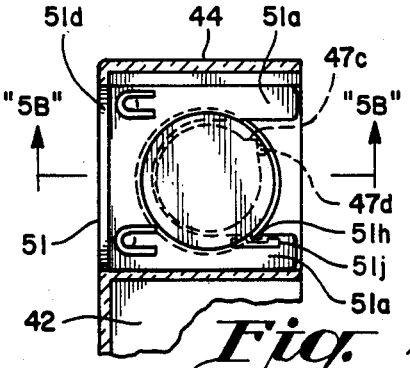
FIG. 4*b* is identical to FIG. 4*a* but shows the U-shaped retaining member in its assembled position showing the parts in their assembled position.

In order that the lock member 51 may be assembled into engagement with the projection 47, the wall of the mounting block 13 is formed with an opening 53 which permits the lock member 51 to be inserted as shown in FIGS. 4 and 5. As shown in the assembled positions in FIGS. 4*b* and 5*b*, the lock member 51 straddles the post portion 47*a* of the projection 47 and is beneath the flange 47*b*. Thus, the projection 47 is restrained from downward movement by the engagement between the flange 47*b* and the lock member 51.

Formed integrally with the lock member 51 are flexible detent arms 51*e* as best shown in FIG. 4*a*. The arms 51*e* are in the plane of lock member 51, being connected at their right ends to member 51, as shown in FIG. 4*a* with U-shaped slots 51*f* defining the arms 51*e* and allowing them to flex out of the plane of the lock member 51 to provide a detent action which retains the lock member 51 assembled to the mounting block 13. The outer end of each arm 51*e* includes a downward projection 51*g* which projects below the plane of lock member 51 engaging a ledge 42*a* in bottom wall 42 of the mounting block 13. Thus, the arms 51*e* flex as the lock member 51 is inserted into opening 53 until the projections 51*g* drop behind the ledges 42*a* to provide a detent action holding member 51 assembled to mounting block 13.

In order to restrict the appliance 15 from rotating more than 90° with respect to the mounting block 13, the post portion 47*a* is provided with a projection 47*c* shown only in FIGS. 4*a* and 4*b*. Except for the area in which the projection 47*c* extends outwardly, the post portion 47*a* is completely cylindrical. However, when the appliance 15 is rotated to the position shown in FIG. 2 of the drawings, the projection 47*c* engages the lowermost leg 51*a* as shown in FIGS. 4*a* and 4*b*, preventing the appliance 15 from rotating further.

The above-described projection 47*c* is formed with a detent stop 47*d* shown only in FIGS. 4*a* and 4*b*. The detent stop 47*d* engages a notch 51*h* formed in the lower leg 51*a* of the lock member 51 when the appliance 15 is pivoted to the knife sharpening position shown in FIG. 2. The portion of the leg 51*a* defining the notch 51*h* is provided with flexibility by having a cutout 51*j* extending lengthwise of the lower leg 51*a* as shown in FIGS. 4*a* and 4*b*. The wall defining notch 51*h* flexes to permit the detent stop 47*d* to snap into engagement with the notch 51*h* in order to latch the appliance in the knife sharpening position.

It should be noted that the projection 47 is integrally formed with the housing 17 with half being formed integrally with the rear housing member 17*a* and half being formed integrally with the front housing member 17*b*.

To increase the rigidity of the support for the appliance 15, there is provided at the end of the housing 17 remote from the projection 47 a headed stud 60 which is adapted to be received with a recess or T-slot 62. The slot 62 includes a narrow opening 62*a* and a wider portion 62*b*. The headed stud 60 is received within the recess 62 with the shank portion snugly received in the slot 62*a* and the headed portion in the wider portion 62*b*. When the headed stud 60 moves into the recess 62, it restricts the appliance 15 from further counterclockwise movement as viewed in FIG. 2 with respect to the mounting block 13.

In the position shown in FIG. 1 with the projection 47 locked into the mounting block 13 by the lock member 51 and with the headed stud received within the recess 62, the appliance 15 is supported in a relatively rigid fashion in a position in which the can opening mechanism, including the feed wheel 25, the cutter 24 and the lever 35 may be conveniently used to open the lid of a can. When it is desired to sharpen a knife, it is simple and convenient to rotate the housing 15 to the position shown in FIG. 2 in which it projects generally perpendicular to the front wall of the cabinet 38, thereby providing easy access to the slots 33*a* and 33*b* in the guard 33 for the grinding wheel 26.

Figure 2:
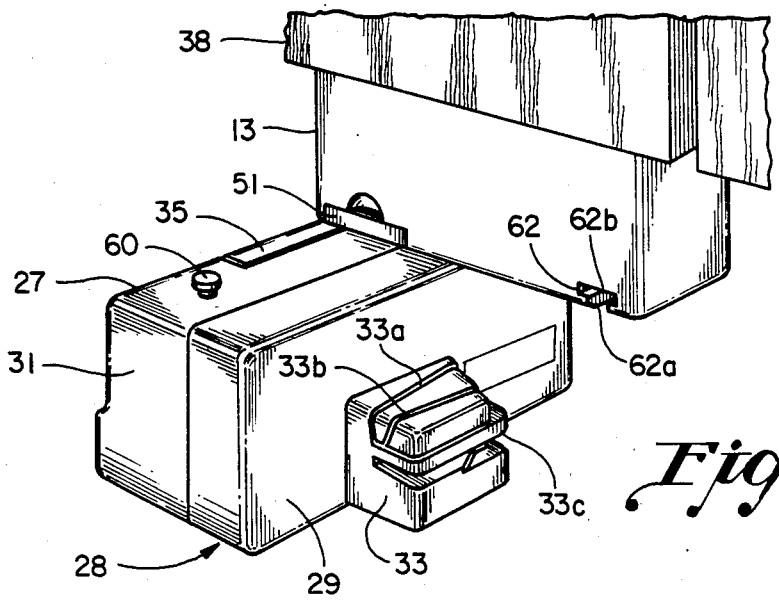
FIG. 2 is a perspective view of the can opener/knife sharpener of FIG. 1 showing the housing rotated to its alternative position for use as a knife sharpener.
Figure 6:
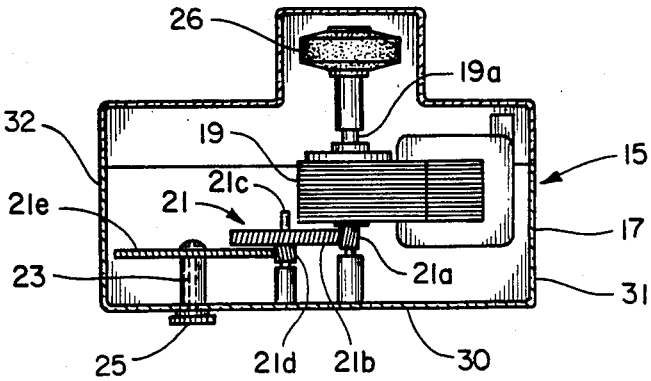
FIG. 6 is a schematic plan view of the interior of the can opener/knife sharpener of my invention showing the arrangement in the housing of the motor, the reduction gearing, the feed wheel shaft and the knife sharpener grinding wheel.

The switch for energizing the motor 19 is positioned to be closed when the lever 35 is depressed from the position shown in FIGS. 1, 2 and 3 as is conventional in can openers of this type. The user may easily depress the lever 35 in either of the positions shown in FIG. 1 and FIG. 2 to operate either the can opener or the knife sharpener. When the appliance 15 is used to open cans, the relatively rigid support provided by the projection 47 at one end and the headed stud 60 supporting the other end of the appliance provides the necessary rigidity. When the appliance 15 is used for sharpening knives, there is little pressure or force applied since the knife blades are only delicately engaged with the grinding wheel 26 and the single support provided by the projection 47 is quite adequate. When the appliance 15 is in the knife sharpening position as shown in FIG. 2, the grinding wheel 26 is positioned well forward of the front of the cabinet 38 so that the operator has a good view of the grinding wheel 26 and the guide slots 33*a* and 33*b* enabling the user to use the appliance most effectively.

The above described can opener/knife sharpener represents a practical solution to the problem of adapting the mechanism of the counter-top, free standing versions of the can opener/knife sharpener to an under-the-cabinet version of such an appliance. In order to utilize the shaded pole motor with the knife sharpening wheel mounted directly on the motor shaft and spur gears for the gear reduction to achieve the lowest cost possible, it is necessary to have the can opener mechanism on the front of the housing and the knife sharpener on the rear thereof. The pivot mounting provided in my invention permits access to utilize both functions and at the same time has sufficient rigidity to allow use of the appliance as effectively as it could have been used with any other type of mounting.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed as new and desired to be secured by Letters Patent of the United States is:

1. A combination can opener and knife sharpener comprising a housing having top and bottom walls interconnected by front, back and a pair of side walls forming an enclosure; a motor and reduction gearing contained within said enclosure, a can driving shaft extending through said front wall and being drivingly connected to said motor through said reduction gearing, a knife sharpening wheel mounted outside of said housing adjacent said back wall; said grinding wheel being rotated by said motor; a support block having means to secure it in a depending position on the bottom of a kitchen wall cabinet of the type which is mounted on a wall and has a front parallel to the wall on which it is mounted, mounting means on said support block and said housing for interconnecting said block and housing to provide movement between a first position in which said front wall of said housing is parallel with the front of said kitchen cabinet and a second position in which said front wall is perpendicular to the front of said kitchen cabinet.

2. The combination of claim 1 wherein said mounting means includes first and second means, and first means comprises a pivotal connection between said housing and said block having means pivoting said housing about a vertical axis and for supporting said housing against axial movement with respect to said block, said second means being spaced from the axis about which said housing pivots and including interfitting parts on said block and on said top wall of said housing for limiting the pivotal movement of said housing in one direction of rotation and for providing support for said housing in the vertical direction.

3. The combination of claim 2 wherein said first means includes a post with a radially extending flange at the unsupported end of said post which projects into a journal bearing engaging the portion of said post between said flange and its supporting portion, said flange functioning as a thrust bearing in restraining said housing from axial movement with respect to said block.

4. The combination of claim 3 wherein said post extends upwardly from the top wall of said housing and said journal bearing is positioned in said block, said block having an opening into which said post extends, said opening being slightly larger in diameter than said flange.

5. The combination of claim 4 wherein said journal bearing comprises a separate U-shaped member which is removably received in a recess in said block adjacent said opening in said block, said U-shaped member being mountable in said recess in engagement with said portion of said post between said flange and the top wall of said housing to journal said post and restrain said post from being withdrawn from said opening.

6. The combination of claim 5 wherein the portion of said post engaged by said U-shaped member includes a radial projection extending between parallel spaced legs of said U-shaped member to limit the rotation of said housing with respect to said block.

7. The combination of claim 2 wherein said second means comprises a headed projection extending upwardly from the top wall of said housing, a slot in said block positioned to receive said headed projection when said housing is rotated from said second position into said first position.

8. The combination of claim 7 wherein said headed projection comprises a small diameter post extending upwardly from the top wall of said housing and having larger diameter head at its upper end, said slot in said block having a narrow portion in the bottom wall of said block which opens into a wider portion which receives said head and thereby supports said housing against vertical movement.

9. The combination of claim 1 wherein said mounting means includes first and second means, said first and second means each including a post projecting from the top wall of said housing and each post includes a head portion at the end which is of greater diameter than a shank portion which supports the head portion, said post of said first means extending into a downwardly facing opening in said block to support said housing for pivotal movement about a vertical axis, said post of said second means being engageable with a T-slot in said block as said housing is rotated from said second to said first position.

10. A combination can opener/knife sharpener comprising a box-like housing defined by top and bottom walls interconnected by front, back and side walls enclosing a shaded pole motor and reduction gearing, a can driving shaft which is journaled in said housing and extends through said front wall to support a can driving wheel, said motor driving said can driving shaft through said reduction gearing, said motor having an armature shaft which extends beyond the rear wall of said housing and supports on its rearwardly extending end a grinding wheel for sharpening knives, a support block having means to secure it in a depending position on the bottom of a kitchen wall cabinet of the type which is mounted on a wall and has a front parallel to the wall on which it is mounted, first and second means on said support block and said housing for interconnecting said block and housing to provide movement between a first position in which said front wall of said housing is parallel with the front of said kitchen cabinet and a second position in which said front wall is perpendicular to the front of said kitchen cabinet.

11. The combination of claim 10 wherein said motor and said reduction gearing are mounted on said front wall of said housing, said reduction gearing including two sets of spur gears having an input gear on said armature shaft and an output gear on said can driving shaft.

12. The combination of claim 11 wherein said first means comprises a pivotal connection between said housing and said block having means pivoting said housing about a vertical axis and for supporting said housing against axial movement with respect to said block, said second means being spaced from the axis about which said housing pivots and including interfitting parts on said block and on said top wall of said housing for limiting the pivotal movement of said housing in one direction of rotation and for providing support for said housing in the vertical direction.

13. The combination of claim 12 wherein said first means includes a post supported at one end on said block or said housing with a radially extending flange at the unsupported end, said post projecting into a journal bearing engaging the portion of said post between said flange and its supporting portion, said flange functioning as a thrust bearing in restraining said housing from axial movement with respect to said block.

14. The combination of claim 13 wherein said post extends upwardly from the top wall of said housing and said journal bearing is positioned in said block, said block having an opening into which said post extends, said opening being slightly larger in diameter than said flange.

15. The combination of claim 14 wherein said journal bearing comprises a separate U-shaped member which is removably received in a recess in said block adjacent said opening in said block, said U-shaped member being mountable in said recess in engagement with said portion of said post between said flange and the top wall of said housing to journal said post and restrain said post from being withdrawn from said opening.

16. The combination of claim 15 wherein the portion of said post engaged by said U-shaped member includes a radial projection extending between parallel spaced legs of said U-shaped member to limit the rotation of said housing with respect to said block.

17. The combination of claim 12 wherein said second means comprises a headed projection extending upwardly from the top wall of said housing, a slot in said block positioned to receive said headed projection when said housing is rotated from said second position into said first position.

18. The combination of claim 17 wherein said headed projection comprises a small diameter post extending upwardly from the top wall of said housing and having larger diameter head at its upper end, said slot in said block having a narrow portion in the bottom wall of said block which opens into a wider portion which receives said head and thereby supports said housing against vertical movement.

19. The combination of claim 11 wherein said first and second means each include a post projecting from the top wall of said housing and each post includes a head portion at the end which is of greater diameter than a shank portion which supports the head portion, said post of said first means extending into a downwardly facing opening in said block to support said housing for pivotal movement about a vertical axis, said post of said second means being engageable with a T-slot in said block as said housing is rotated from said second to said first position.

20. The combination can opener/knife sharpener of claim 10 wherein said first and second means are positioned with respect to said grinding wheel so that in said second position of said housing said grinding wheel is located in front of a vertical plane defined by the front of said kitchen cabinet.

* * * * *